US009016505B2

(12) United States Patent
Canegallo

(10) Patent No.: US 9,016,505 B2
(45) Date of Patent: Apr. 28, 2015

(54) FLEXIBLE CONTAINER FOR PACKAGING, IN PARTICULAR IN STERILE CONDITIONS, OF FOOD PRODUCTS AND RELATIVE PACKAGE COMPRISING SAID FLEXIBLE CONTAINER

(75) Inventor: Pierottavio Canegallo, Tortona (IT)

(73) Assignee: GRC Pack Luxembourg S.A., Luxembourg (LU)

( * ) Notice: Subject to any disclaimer, the term of this patent is extended or adjusted under 35 U.S.C. 154(b) by 723 days.

(21) Appl. No.: 13/002,714

(22) PCT Filed: Jul. 7, 2009

(86) PCT No.: PCT/EP2009/004909

§ 371 (c)(1), (2), (4) Date: Mar. 29, 2011

(87) PCT Pub. No.: WO2010/003639

PCT Pub. Date: Jan. 14, 2010

(65) Prior Publication Data

US 2011/0167769 A1 Jul. 14, 2011

(30) Foreign Application Priority Data

Jul. 7, 2008 (EP) ..... 08012211

(51) Int. Cl.
*B65D 17/42* (2006.01)
*B65D 75/00* (2006.01)
(Continued)

(52) U.S. Cl.
CPC ..... *B65D 75/008* (2013.01); *B65D 51/226* (2013.01); *B65D 75/5883* (2013.01); *B65D 2101/003* (2013.01)

(58) Field of Classification Search
CPC ..... B65D 35/10; B65D 2101/003; B65D 21/003; B65D 1/003; B67B 7/26
USPC ..... 220/277, 222, 258.4, 267, 212, 660; 222/107, 83.5, 80, 566, 572, 574, 92; 53/469; 383/119, 105, 108, 120, 107, 383/115; 206/361, 277, 219–221, 823; 493/243
See application file for complete search history.

(56) References Cited

U.S. PATENT DOCUMENTS 2,198,564 A * 4/1940 Robison ..... 222/82
3,245,564 A * 4/1966 Hirsch ..... 215/213
(Continued)

FOREIGN PATENT DOCUMENTS

WO 98/23498 A1 6/1998
WO 03/002419 A1 1/2003
WO 03/066453 A1 8/2003

*Primary Examiner* — David Fidei
*Assistant Examiner* — James M Van Buskirk
(74) *Attorney, Agent, or Firm* — Seed IP Law Group PLLC

(57) ABSTRACT

The present invention regards a package (1) for food products comprising a flexible container (2) having a first wall (5) and a second wall (6) opposite each other and peripherally sealed along at least the respective side edges (5*a*, 6*a*, 5*b*, 6*b*), a space (8) inside said walls containing, optionally in sterile conditions, a food product (73), and a gusset element (10) extended between the upper edges (5*c*, 6*c*) of said first wall (5) and of said second wall (6), said gusset element (10) defining a pocket (14) turned towards the interior of said flexible container (2), characterized in that it comprises an opening and closing device (3) housed in said pocket (14) and constrained to said flexible container (2), said opening and closing device (3) comprising a pourer body (15) associated with an opening and closing cap (16), and cutting means (42) suitable to perforate said flexible container (2) at the time of the first opening of said packaging (1). The invention also regards a method for packaging a food product, in particular in sterile conditions, in a package of the aforesaid type, a flexible container for a package of the aforesaid type as well as a method for producing such container.

11 Claims, 11 Drawing Sheets

(51) Int. Cl.
*B65D 51/22* (2006.01)
*B65D 75/58* (2006.01)

(56) References Cited

U.S. PATENT DOCUMENTS 3,407,976 A * 10/1968 Homma ..... 222/485
4,088,166 A * 5/1978 Miller ..... 604/408
4,090,541 A * 5/1978 Cammarata et al. ..... 604/408
4,452,378 A * 6/1984 Christine ..... 222/107
4,669,124 A * 5/1987 Kimura ..... 383/80
5,141,133 A * 8/1992 Ninomiya et al. ..... 222/83
5,307,955 A 5/1994 Viegas
6,279,779 B1 * 8/2001 Laciacera et al. ..... 222/83
6,460,732 B1 * 10/2002 Drennow ..... 222/83
6,752,264 B2 * 6/2004 Versluys ..... 206/219
6,820,764 B2 * 11/2004 Miani et al. ..... 222/83

* cited by examiner

FLEXIBLE CONTAINER FOR PACKAGING, IN PARTICULAR IN STERILE CONDITIONS, OF FOOD PRODUCTS AND RELATIVE PACKAGE COMPRISING SAID FLEXIBLE CONTAINER

FIELD OF APPLICATION

In its most general aspect, the present invention refers to the food product packaging sector.

In particular, the present invention regards a packaging for food products comprising a container made of a flexible material, such as a pouch, bag and the like, and a related packaging method in particular not exclusively in sterile conditions.

The present invention also regards a flexible container for a package of the aforesaid type as well as a method for the production of said container.

PRIOR ART

The use of packages composed of or comprising flexible material containers is well known, in particular, pouches, bags and the like for packaging liquid or semi-liquid food products such as for example drinks or juices, as well as solid food products having appropriate fluidity (or flow) characteristics, such as for example powder or granular food products.

Such containers are generally obtained from a sheet (or even several sheets) of an appropriate flexible material, which is folded and sealed at least on its side, so to define a bottom, two opposite side walls between which an inner space is formed for the food product, said opposite walls terminating on their upper part with a mouth for inserting the food product.

The packaging normally provides for the filling of the flexible containers with the pre-selected food product from the upper mouth and the subsequent sealing of the edges of the mouth, so to hermetically close the container with the food product inside and thus obtain the final package. The sealing operation can be carried out by directly heat welding or by ultrasound welding the aforesaid edges to each other so to make them integral by means of melting or, more frequently, by first interposing an opening and closing device provided with appropriate sealing surfaces between the edges of the open container and then heat or ultrasound welding the edges against the sealing surfaces of the opening and closing device. In the latter case, there is in fact the advantage of rendering the container reclosable after, for example, a partial administration of the food product contained therein.

More in particular, the aforesaid opening and closing device comprises a pourer body in a rigid plastic material for administering the food product, said pourer body being provided with said surfaces for the sealing between the opposite edges of the mouth, and an opening and closing element, normally a cap, associated in a removable manner with the pourer body, for example by means of a thread coupling for the unscrewing and screwing of the cap from and on the pourer body as necessary.

Although the package and packaging system described above substantially meet the object for which they were designed, they have several drawbacks which still today have yet to be resolved in a satisfactory manner.

One drawback lies in the fact that it is very difficult to optimally seal (i.e. without defects) the opening and closing device between the edges of the mouth of the open flexible container, in particular in substantially triangular cross-section zones near the pourer body in which the walls of the edges subjected to sealing diverge—this notwithstanding the generally good compatibility of the material subjected to sealing constituting the container and pourer body.

Consequently, it often occurs that the flexible container is not hermetically closed as desired, to the point that it can allow the exit of the food product contained therein towards the outside, as well as the entrance of air inside the container with consequent possible deterioration of the organoleptic characteristics of said food product and compromising the shelf-life indicated on the label.

Such drawback has greater importance where the flexible container was previously sterilised and the food product was packaged in sterile (or aseptic) conditions, for example due to its high degradability and/or for increasing its shelf-life.

Another drawback lies in the fact that the opening and closing device applied to the top of the flexible container can cause holes and/or tears in the walls of the container itself during the use of the package, due to its rigid characteristics which contrast with the flexible characteristics of the container. This can occur particularly in the case of clumsy use of the packaging but even during normal opening and closing operations of the container by means of the aforesaid device.

A further drawback lies in the fact that the packaging process with a flexible container of the aforesaid type is long and complex. In particular, in case of sterile or aseptic packaging, it is necessary to carry out in sterile or aseptic conditions not only the filling of the flexible container (upon being rendered it sterile) with the preselected food product, but also and above all the sealing operation to prevent the food product from being contaminated by bacteria or other impurities since the opening and closing device is applied to the flexible container while it is still open.

This implies that even the opening and closing device must be subjected to previous sterilisation and that suitable sterility conditions must be maintained in at least until the completion of the sealing of the aforesaid device between the edges of the mouth of the container.

It is clear that all of the above renders the making and functioning of the equipment set for the above-described packaging considerably complicated and costly.

The application WO 98/23498 on behalf of The Coca-Cola Company describes a pouch for packing drinks. The pouch comprises two laterally sealed opposite walls and two gusset elements respectively arranged above and below the opposite walls so to define with the latter a space for containing a drink.

In particular, the upper gusset element is composed of a folded sheet made of a flexible and frangible material whose fold returns inward so to define a pocket at the upper end of the pouch for the insertion of a straw by a consumer, with which such consumer perforates said upper gusset element, so accessing the pouch content. In such a manner, a facilitated insertion of the straw inside the pouch is allowed, at the same time minimising the risk of accidentally perforating or tearing the walls of the pouch, with consequent product outflow.

Nevertheless, it should be noted that the manufacture of the aforesaid pouch is rather complicated, since two separate sheets of flexible material are required for the aforesaid opposite walls; moreover, the sealing of separate gusset elements to the respective upper and lower edges of said walls is also required. The flexible material of the sheets must moreover have a limited resistance, so to be easily pierced by means of the aforesaid straw.

In addition, the application WO 98/23498 does not envisage the possibility of being able to reclose the pouch, once open, but limits its use in association with a straw or similar perforating means of the gusset element. Moreover, such use can be difficult for the consumer, since, in accordance with the application WO 98/23498, it is first necessary to "open"

the pocket by folding outwardly one or both sheets of flexible material composing the walls of the pouch at an upper end position thereof, and then inserting the straw in the pocket until the gusset element is broken, so to access the contents of the pouch.

The problem underlying the present invention is therefore that of providing a package comprising a flexible container for packaging food products, in particular but not exclusively in sterile or aseptic conditions, as well as a relative packaging method which overcomes the drawbacks mentioned above with reference to the prior art.

SUMMARY OF THE INVENTION

Such a problem is solved, according to the invention, by a package for food products comprising a flexible container having a first wall and a second wall opposite each other and peripherally sealed along at least the respective side edges, a space inside said walls containing, optionally in sterile conditions, a food product, and a gusset element extended between the upper edges of said first wall and said second wall, said gusset element defining a pocket turned towards the interior of said flexible container, characterised in that it comprises an opening and closing device housed in said pocket and constrained to said flexible container, said opening and closing device comprising a pourer body associated with an opening and closing cap, and cutting means suitable to perforate said flexible container at the time of the first opening of said container.

Such a technical problem is also solved by a flexible container and by an opening and closing device of such flexible container for packaging of a food product in a package of the aforesaid type.

Such a flexible container comprises a first wall and a second wall opposite each other and peripherally sealed along the respective side edges, a space inside said walls for containing, optionally in sterile conditions, a food product, and a gusset element extended between said first wall and said second wall, and is characterised in that said container is formed by a single sheet of flexible material folded so to form said first wall and said second wall and said gusset element.

With the term "sheet of flexible material", it is intended any flexible monolayer or multilayer (composite) sheet of an appropriate material for foods and having a predetermined thickness. It can be formed, as a non-limiting example, by a sheet of metal material, in particular aluminium or a composite sheet comprising a metal coupled with a plastic, cardboard and/or card material.

The opening and closing device for the aforesaid flexible container comprises a pourer body associated with an opening and closing cap, said pourer body comprising a base associated with said container and provided with a substantially cylindrical through channel of predetermined axis X, a coaxial neck provided with cutting means suitable to perforate said flexible container at the first opening thereof, said neck being rotatably engaged and movable in said channel between an upper end stop position wherein said cutting means are situated in said channel in a condition of maximum removal from the container and a lower end stop position wherein said cutting means are in a position of maximum advancement and are capable of perforating said container, and it is characterised in that said neck comprises an upper end portion provided with outer thread along a its axial part in threaded coupling with an inner thread of said cap and a lower end portion provided with outer thread along a its axial part in threaded coupling with an inner thread of said channel, said thread of the upper end portion and said thread of the lower end portion being made in substantially opposite directions so to allow, at the time of the first opening of said package, the perforation of said flexible container and the subsequent screwing off of the cap by means of a prolonged rotary movement in a single direction.

The present invention also regards a method for producing a flexible container of the aforesaid type comprising the steps of:

- providing a sheet of flexible material,
- folding said sheet so to form a first wall and a second wall opposing each other, a gusset element extended between the upper edges of said first wall and said second wall and optionally a gusset bottom extended between the lower edges of said first wall and said second wall;
- laterally sealing said first wall and said second wall together, to respective walls of the gusset element and optionally to respective walls of the gusset bottom, obtaining in this way a substantially flattened flexible container, open on its upper part along a mouth at upper facing edges of a wall of said gusset element and said first wall or said second wall;
- optionally sealing said facing edges of the mouth, so hermetically closing said container.

Preferably, the aforesaid method further comprises the step of sterilising said open container before the sealing of said facing edges.

The present invention also regards a method for packaging a food product in a package comprising a flexible container of the aforesaid type, the method comprising the steps of:

- providing a flexible container comprising a first wall and a second wall opposite each other, a gusset element extended between the upper edges of said first wall and said second wall and optionally a gusset bottom extended between the lower edges of said first wall and said second wall, said container being open on its upper part along a mouth at facing upper edges of a wall of said gusset element and of said first wall or of said second wall;
- filling said open flexible container with a food product, through said mouth,
- optionally sealing said facing edges of the mouth, so to hermetically close said container,
- inserting an opening and closing device in a pocket defined by said gusset element and constraining it to said gusset element, said opening and closing device comprising a pourer body associated with an opening and closing cap, and cutting means suitable to perforate said container at the time of the first opening of said package.

Preferably, the aforesaid packaging method further comprises a step for sterilising said open container before said filling step. In such case, said filling step and said step for sealing the facing edges of the mouth are carried out in sterile conditions.

In the above-described methods of the present invention, the sealing is carried out according to conventional techniques such as heat-welding, also known with the term heat-sealing, ultrasound welding, use of adhesives etc.

Further characteristics and advantages of the present invention will be clearer from the following description of some preferred embodiments, said description being given as indicative and non-limiting purpose with reference to the attached figures.

DETAILED DESCRIPTION

Figure 1:
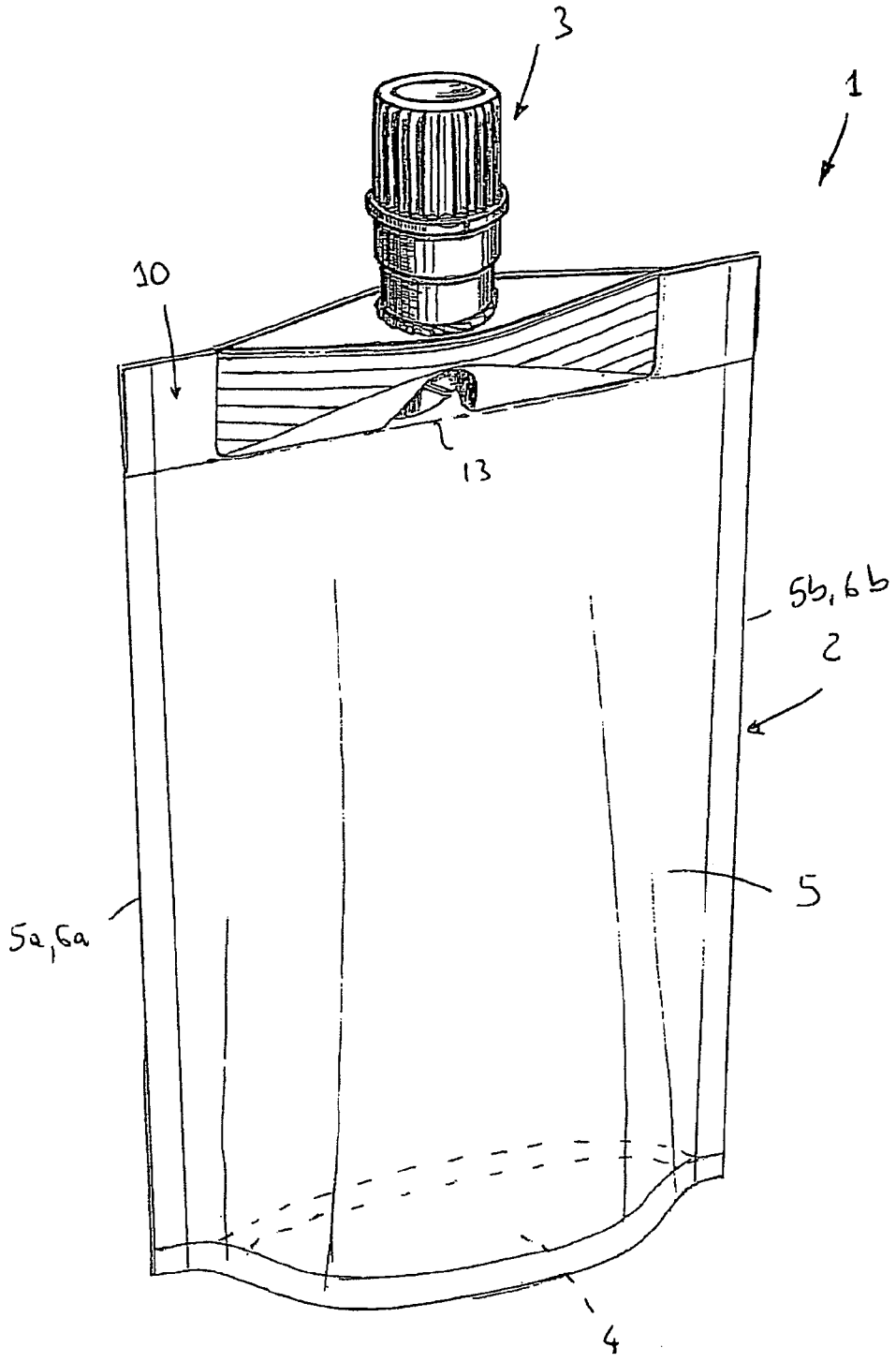
FIG. 1 represents a perspective view of a package according to the present invention comprising a container and an associated opening and closing device and wherein the container is shown partially broken in an upper end portion.
Figure 2:
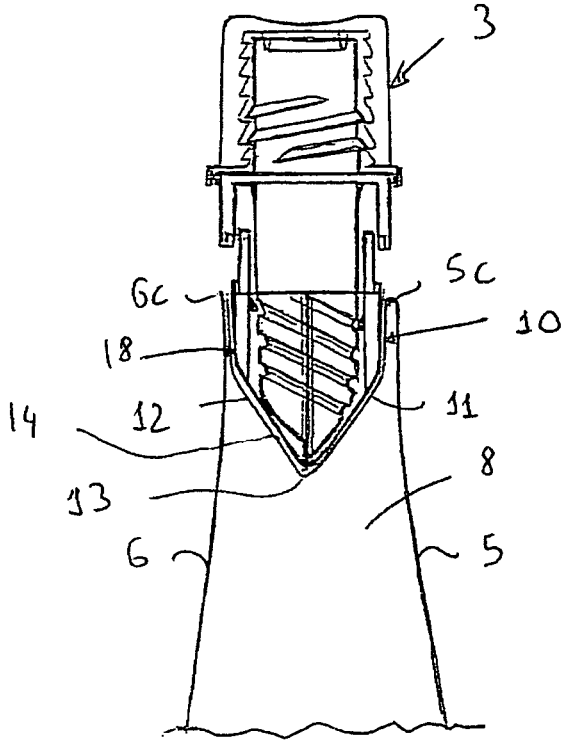
FIG. 2 represents a side section view of an upper portion of the package of FIG. 1.
Figure 3:
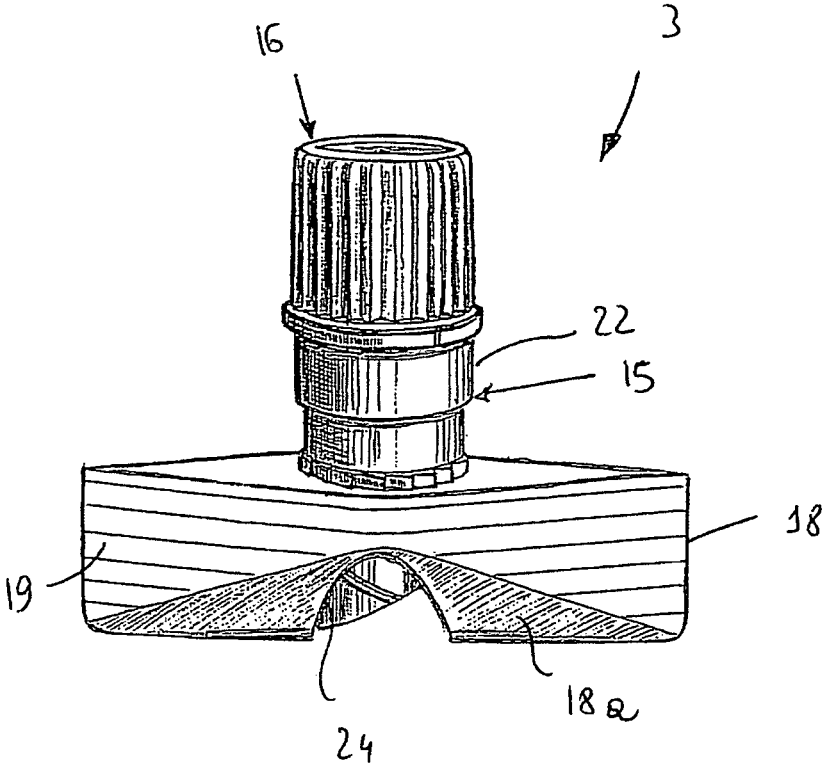
FIG. 3 represents a front view of the opening and closing device of the package of FIG. 1.
Figure 4:
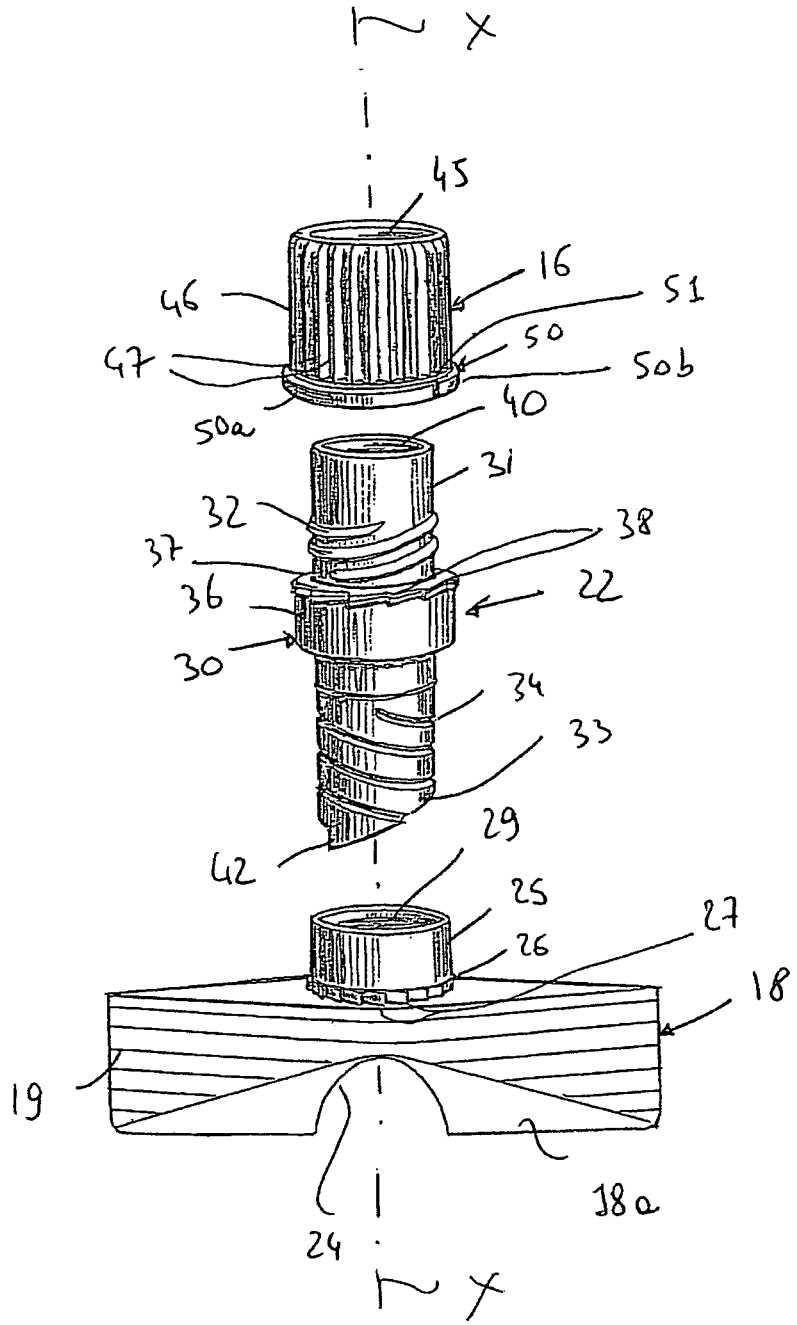
FIG. 4 represents a front exploded view of the opening and closing device of FIG. 1.

With reference to FIGS. 1 and 2, a package for food products according to the present invention is indicated in its entirety with the reference number 1.

The package 1 comprises a container made of flexible material, precisely a pouch 2, and an opening and closing device indicated in its entirety with the reference number 3, associated with the upper part of the pouch 2.

The pouch 2 is formed by a flexible monolayer or multilayer (composite) sheet of an appropriate material for foods. It can be formed, as a non-limiting example, by a metal material sheet, in particular aluminium or a composite sheet comprising a metal and plastic material for foods and/or cardboard or card.

In particular, the pouch 2 comprises a bottom 4, a first wall 5 and a second wall 6 substantially opposite each other and peripherally sealed at respective first side edges 5*a* and 6*a* and respective second side edges 5*b* and 6*b*, and a space 8 for containing a liquid or solid food product inside the first wall 5 and second wall 6.

The pouch 2 also comprises a gusset element 10 arranged at the upper end thereof, extended between the respective upper edges 5*c* and 6*c* of the first wall 5 and of the second wall 6.

In particular, as is better visible in FIG. 2, the gusset element 10 has a substantially "V" shaped general form and comprises a first tilted wall 11 and a second tilted wall 12 converging downward, that is towards the inside of the pouch 2, so to form a "V" in side view, the tilted walls 11 and 12 terminating on their lower part in a fold 13.

In the present embodiment, the fold 13 is substantially linear and is extended up to opposing side edges 5*a*, 6*a* and 5*b*, 6*b* of the first wall 5 and of the second wall 6.

With particular reference to FIG. 2, it should be noted that, in accordance with the invention, the gusset element 10 is advantageously composed of a end portion of the first wall 5, said end portion being suitably folded to form the first tilted wall 11, the second tilted wall 12 and the fold 13 between them. In particular, one of the two tilted walls, precisely the first tilted wall 11, is sealed to the first wall 5 of the pouch 2 at respective opposing side walls 5*a* and 5*b* while the other of the two tilted walls, precisely the second tilted wall 12, is sealed to the second wall 6 of the pouch 2 at the respective opposing side edges 6*a* and 6*b* and of the upper edge 6*c*.

In such a manner, in accordance with the present invention, the gusset element 10 defines a pocket 14 at the upper end of the pouch 2, which constitutes the seat for housing the opening and closing device 3.

In the packaging 1 according to the invention, the opening and closing device 3 is suitably inserted with its lower portion 18, better specified below, in a pocket 14 defined by the first tilted wall 11 and by the second tilted wall 12 of the gusset element 10. Such pocket 14 is suitably shaped around such lower portion 18 of the opening and closing device 3 by means of sealing the first tiled wall 11 and the second tilted wall 12 together along respective end portions and around the lower portion 18 along respective substantially central portions.

Regarding the opening and closing device 3, it should be said that it comprises, as main elements, a pourer body, indicated with 15 in tis entirety, and a cap 16 which are coaxially associated with each other along an axis X.

More in particular, the pourer body 15 comprises a base 18 having a substantially canoe shape, internally provided with a substantially cylindrical channel 20 coaxial with reference to the aforesaid X-X axis for the passage of a food product, and a neck 22 rotatably engaged in said channel 20, said neck 22 being provided on its lower part with rotatable cutting means for opening the container 2, defined below.

The base 18 is composed of a rigid block of a suitable material for foods, preferably a plastic material, and constitutes the aforesaid lower portion of the opening and closing device 3 housed in the pocket 14 defined by the first tilted wall 11 and by the second tilted wall 12 of the gusset element 10.

More in particular, the base 18 has two opposite symmetric sealing surfaces 19 with respect to a vertical plane of symmetry, by means of which it is sealed to the tilted walls 11,12 of the gusset element 10. Advantageously, the surfaces 19 can be rendered rough in order to improve the sealing of the base 11 to the tilted walls 11,12 of the gusset element 10.

In addition, a lower end portion 18*a* of the base 18 is tapered on its lower part in the direction of the aforesaid axis X-X so to have a substantially conical form in cross section. This advantageously allows better adapting the base 18 to the shape of the pocket 14 of the gusset element 10 so to have matching forms as much as possible, to the complete advantage of increased simplicity for housing the base 18 in the pocket 14 and an increased effectiveness of the seal of said base 18 to the tilted walls 11,12 of the gusset element 10.

In addition, it should be noted that the aforesaid end portion 18*a* has an axial notch 24 with curvilinear profile formed at the channel 20. This advantageously permits tensioning the flexible material of the pocket 18 in a perforation zone of the container 2 by the opening and closing device 3.

The base 18 also comprises a substantially cylindrical collar 25 formed integrally therewith and projecting above it, the collar 25 being coaxial with the channel 20. In other words, the collar 25 constitutes a kind of upper end extension of the channel 20 outside the base 18.

In addition, an annular band 26 outside the collar 25 situated at the lower end thereof, i.e. at the upper surface of the base 18, has a plurality of teeth 27 formed integrally with the collar 25 in circumferential succession; its function will be explained below.

Alternatively to the annular band 26, a separate ring can be provided having said teeth formed integrally in circumferential succession, said ring being fit on the collar 25 and constrained thereto by means of suitable bridges.

Regarding the channel 20 inside the base 18, it should be said that it has internally a thread 28 along a short axial part in order to rotatably engage the neck 22 as will be better described below; in addition, a pair of annular reliefs, precisely an upper annular relief 29*a* and a lower annular relief 29*b*, is provided inside the collar 25, said annular reliefs forming an upper end stop for the movement of the neck 22 and interacting, in the manner which will be better explained below, with a corresponding annular relief (ring) 29*c* formed on the neck 22 atop the threaded section 28.

In particular, in said upper end stop position, the ring 29*c* of the neck 22 is situated between the upper annular relief 29*a* and the lower annular relief 29*b* of the collar 25. In addition, the ring 29*c* of the neck 22 suitably interacts with the inner walls of the channel 20 advantageously preventing any leakage of liquids through the channel 20 once the container 2 is open (perforated).

Regarding the neck 22, it should be said that it comprises a substantially cylindrical body 30, coaxial with respect to the aforesaid X axis and having an upper end portion 31 provided with outer thread 32 along an axial part thereof, a lower end portion 33, also provided with outer thread 34 along an axial part thereof and an intermediate portion 35 between the upper end portion 31 and the lower end portion 33 free of thread.

The cylindrical body 30 internally has a channel 40 for the passage of a food product which is coaxial with the channel 20 of the base 18, said channel 40 being axially extended along the entire upper end portion 31, the lower end portion 33 and the intermediate portion 35 and being open at the lower end and at the upper end of the neck 22.

The lower portion 33 of the cylindrical body 30 terminates on its lower part with a blade 42 that is eccentric with respect to the axis X-X in order to open the pouch 2, said blade being obtained by cutting the lower part of the cylindrical body 30 along a cutting plane that is titled with respect to the axis X-X.

The neck 22 also has a cylindrical jacket 36 formed integrally therewith which rises over the intermediate portion 35 of the cylindrical body 30, the cylindrical jacket 36 being provided on its upper part with a plurality of teeth 38 in circumferential succession along an annular band 37 and projecting therefrom, and on its lower part with an inner annular recess 39 intended to be substantially fit-coupled with the teeth 27 of the collar 25 of the base 18 at the time of the first opening of the packaging 1.

The cap 16 comprises a head 45 an annular jacket 46 externally provided with knurling 47 and internally provided with a thread 48 which, together with the outer tread 32 of the upper end portion 31 of the neck 22, forms a thread coupling for the screwing and unscrewing of the cap 16 on and from the neck 22 of the pourer body 15 as needed.

The cap 16 also has a guarantee band composed of a ring 50 fit on the annular jacket 46 and constrained thereto by means of appropriate bridges (not shown), the ring 50 being internally provided with a plurality of teeth, not shown since they are entirely conventional, which are engaged between the teeth 38 of the cylindrical jacket 36 of the intermediate portion 35 of the neck 22 according to a substantially toothed coupling.

In such a manner, the cap 16 is rendered integral in rotation with the neck 22 of the pourer body 15.

It should be noted that, in the present example, the ring 50 is divided into two equivalent and semicircular parts 50*a* and 50*b*, by means of two diametrically opposed cuts which are held together by means of diametrically opposed lines of weakening 51.

In accordance with one aspect of the present invention, the neck 22 is rotatably engaged on its lower part with the base 18 by means of a thread coupling between the outer thread 34 of the lower end portion 33 and the inner thread 28 of the channel 20 of the base 18. In particular, such thread coupling allows a rotary movement of the neck 22 from an upper end stop position in which the eccentric blade 42 of the lower end portion 31 is situated inside the channel 20 in the position of maximum removal from the container 2, to a lower end stop position corresponding to the fit-engagement of the annular recess 39 with the teeth 27 of the collar 25, in which the eccentric blade 42 is in maximum advancement position and capable of perforating the container 2 at the gusset element 10 (in particular at the fold 13) placing the inner space 8 of the pouch 2 in fluid communication with the pourer body 15 and specifically with the channel 40 of the neck 22.

It should also be noted that, in accordance with another aspect of the invention, the thread 31 of the upper end portion 31 of the neck 22 and the thread 34 of the lower end portion 33 are made in substantially opposite directions. This advantageously allows the user, at the time of the first opening of the package 1, to perforate the gusset element 10 of the container 2 and to subsequently unscrew the cap 16 from the neck 22 by means of a rotary movement in a single direction.

More in particular, in the condition preceding the first opening of the packaging 1 (FIG. 5), the pouch 2 is hermetically closed and the eccentric blade 42 of the opening and closing device 3 is in maximum removal position in the channel 20 of the base 18.

Figure 5:
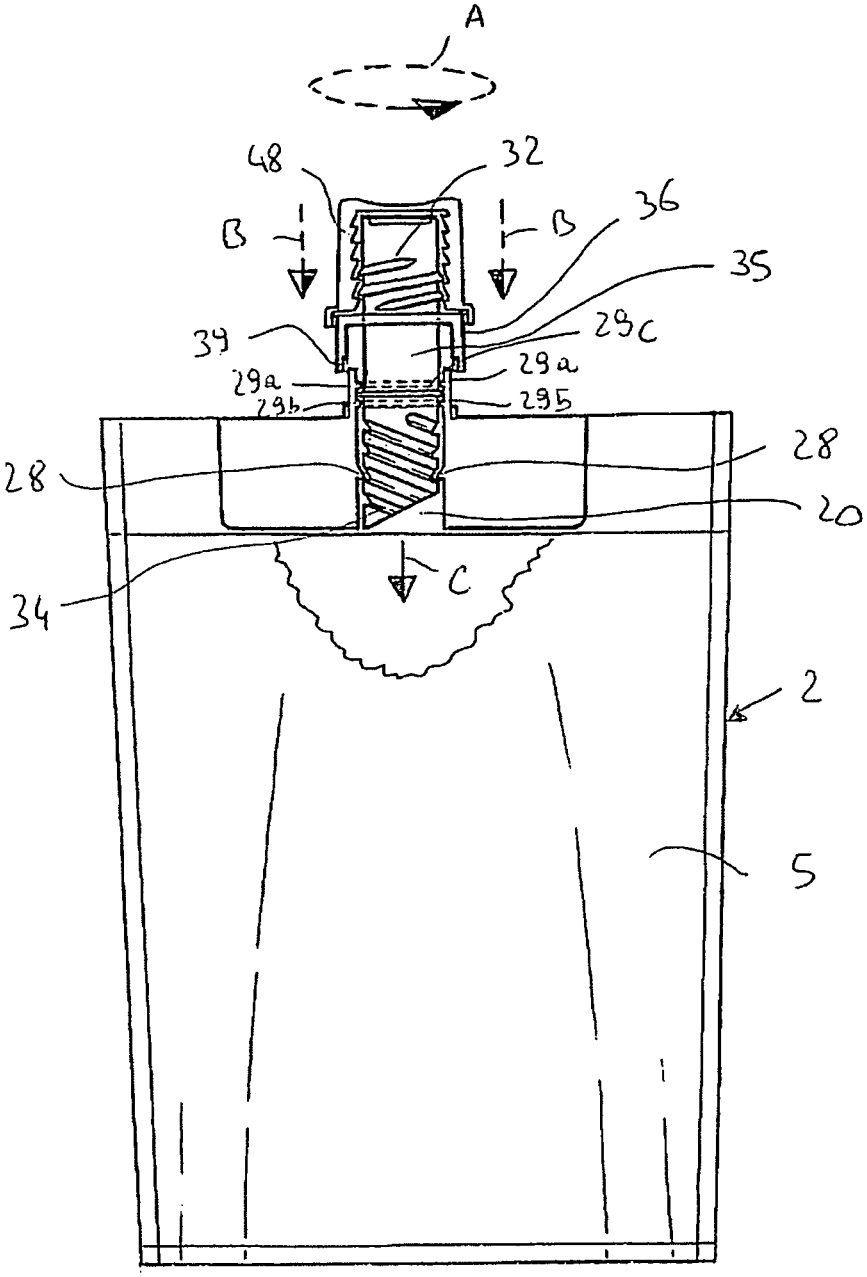
FIGS. 5-7 each show a front view, in partial section, of the package of FIG. 1 in respective operative opening steps of the same and wherein the container is shown partially broken.

In order to opening the package 1, it will suffice that the consumer rotates the cap 16 in a predetermined direction (for example the anticlockwise direction represented by the arrow A in FIG. 5), advantageously gripping the knurling 47 of the cylindrical jacket 46, until the lower end stop position is reached of the eccentric blade 42 corresponding with the maximum advancement of said blade in the pouch 2. Such rotation involves, as shown by arrows B and C in FIG. 5, the lowering of the neck 22 with the related blade 42 and the cap 16 integral in rotation therewith and the perforation of the pouch 2 by the blade 42 at the fold 13 of the gusset element 10. In particular, the lowering of the neck 22 from the upper end stop involves the passage of its annular relief 29*c* below the lower annular relief 29*b* of the collar 25 (due to the rotation force and to the fact that the material composing the annular reliefs 29*a* and 29*b* has suitable elasticity) and terminates with the attainment of the lower end stop with the locking of the neck 22 to the base 18 by means of the fit-coupling of the cylindrical jacket 36 at its inner annular recess 39 with the teeth 27 of the collar 25 of the base 18 (FIG. 6).

Figure 6:
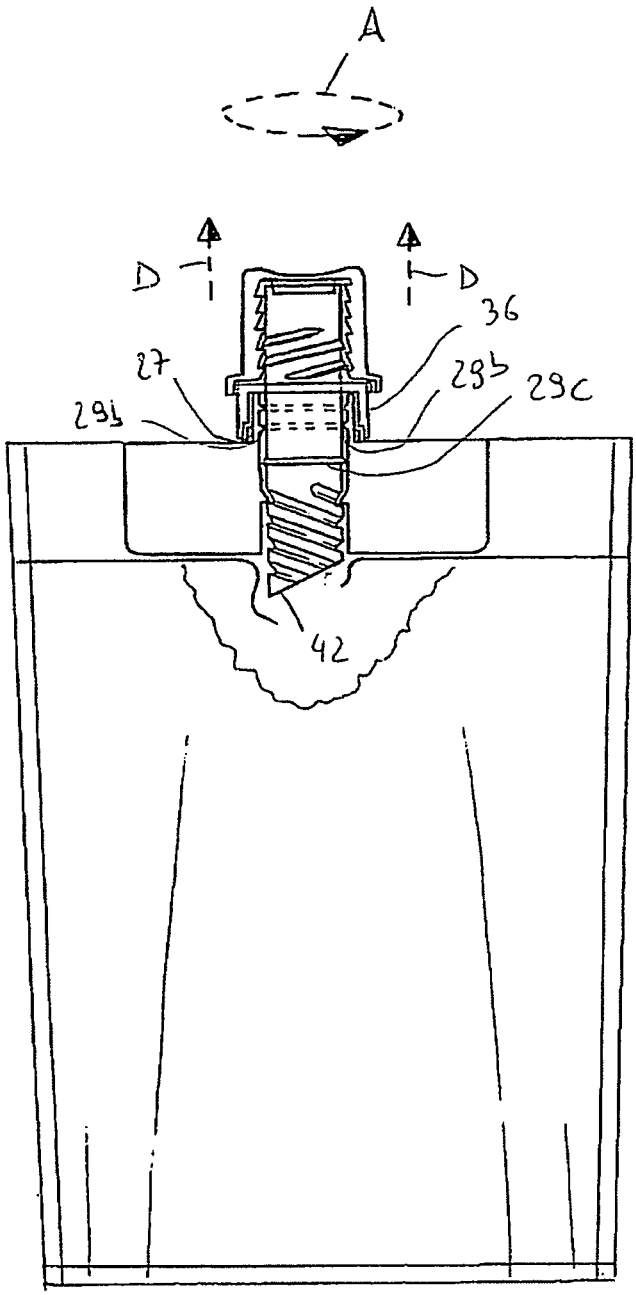
Figure 7:
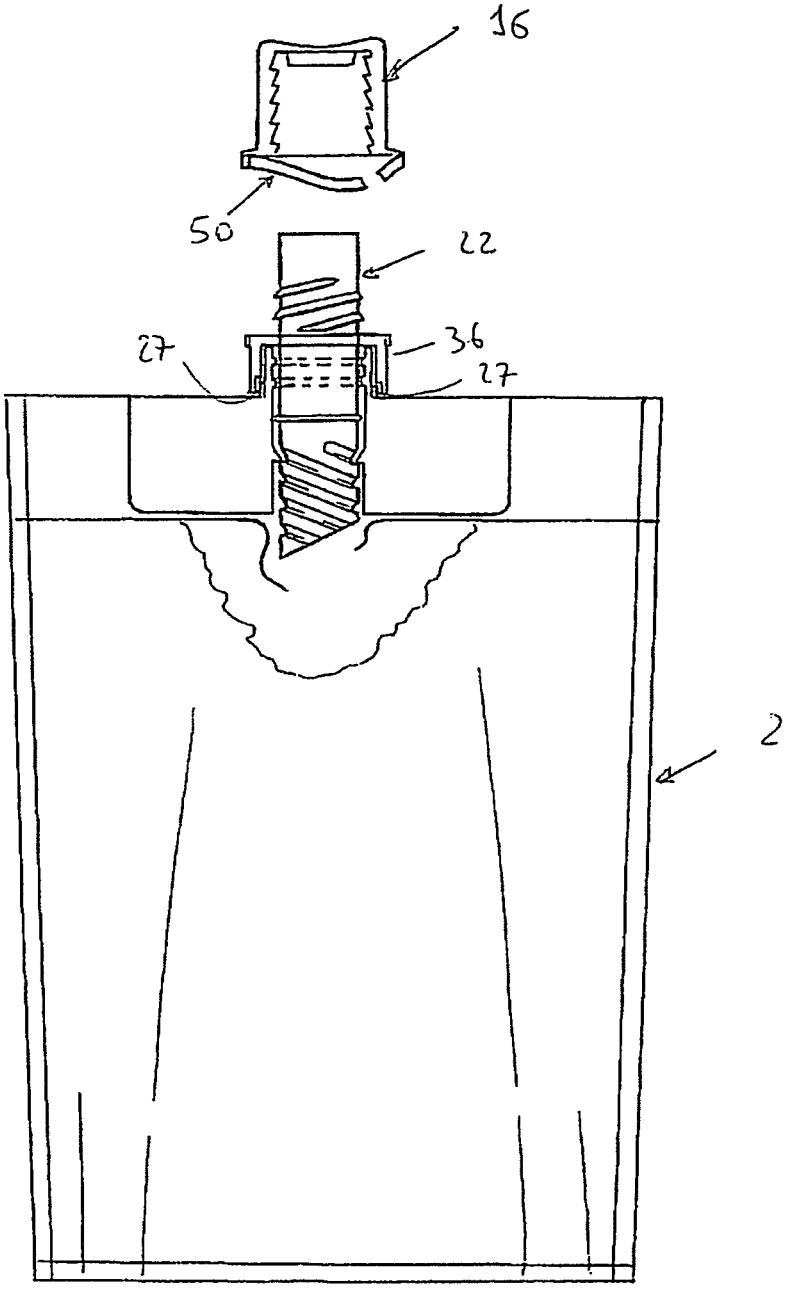

At this point, by continuing the rotation of the cap 16 in the same direction (anticlockwise direction represented by the arrow A in FIG. 6), the consumer will tear the ring 50 constituting the guarantee band along the lines of weakening 51, and will be able to unscrew the cap 16 from the neck 22, thus accessing the contents of the pouch 2 as represented by the arrows D in FIG. 6. The final result of the first opening of the package 1, after unscrewing the cap 16, is shown in FIG. 7.

It should be noted that the package is also readily recloseable, since the consumer, with every dispensing of a desired quantity of the food product in the pouch 2, can easily reclose the packaging 1 by screwing the cap 16 to the upper end portion 31 of the neck 22, the latter being firmly held in position by the fit-coupling of the cylindrical jacket 36 at its inner annular recess 39 with the teeth 27 of the collar 25 of the base 18.

Figure 8:
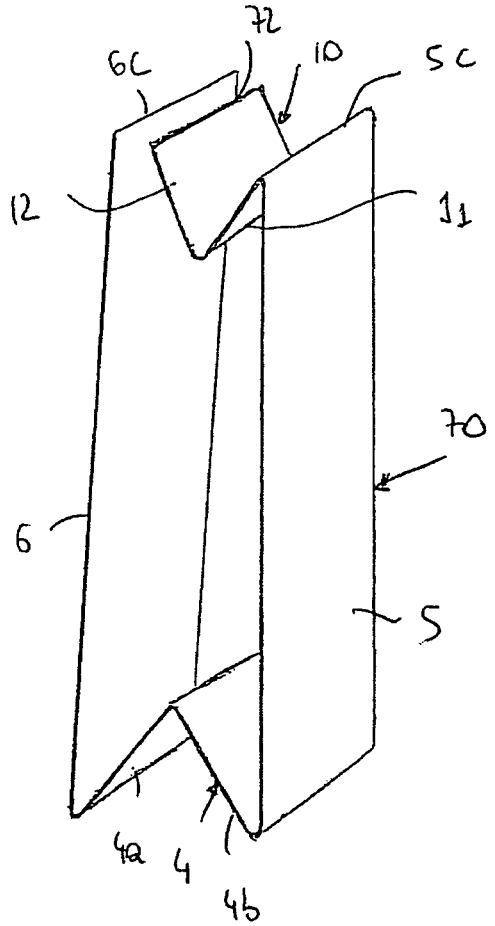
FIGS. 8 and 9 show respective manufacture steps of a flexible container according to the invention.
Figure 9:
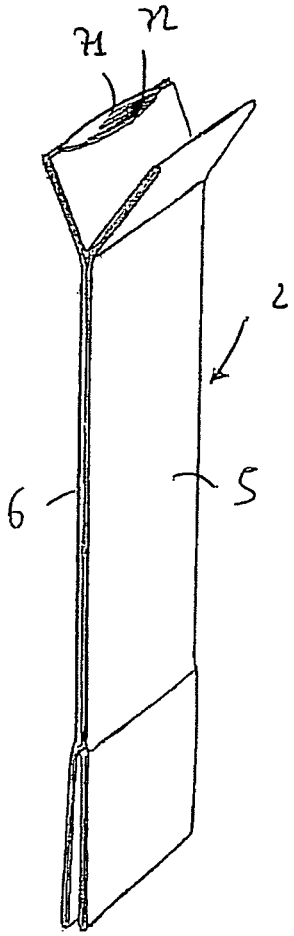

With reference now to FIGS. 8 and 9, a preferred method is shown for making the container 2 in flexible material according to the invention.

Advantageously, in the method according to the invention, the container 2 is obtained by a single sheet 70 made of a flexible material. Such sheet 70 is suitably folded (FIG. 8) so to form a gusset bottom 4 with respective walls 4*a* and 4*b* tilted inwardly, a first wall 5 and a second wall 6 opposite each other and an upper gusset element 10 provided with a first wall 11 and a second wall 12 both tilted inwardly, the upper gusset element 10 being composed of a folded end portion of one of said walls 5,6 (in the specific case, the first wall 5) and being extended between the respective upper edges 5*c*, 6*c* of the first wall 5 and of the second wall 6.

Then, the first wall 5 and the second wall 6 are laterally sealed together, as laterally sealed are the walls 4*a* and 4*b* composing the gusset bottom 4 and the walls 11,12 composing the gusset element 10, each to a respective wall among the first wall 5 and the second wall 6, in such a manner obtaining a substantially flattened flexible container open on its upper part along a substantially horizontal mouth 71. In particular, in the present example, such mouth 71 is formed between the upper edge 6*c* of the second wall 5 and the free end of the gusset element 10, i.e. the upper non-sealed edge 72 of the second tilted wall 12.

Figure 10:
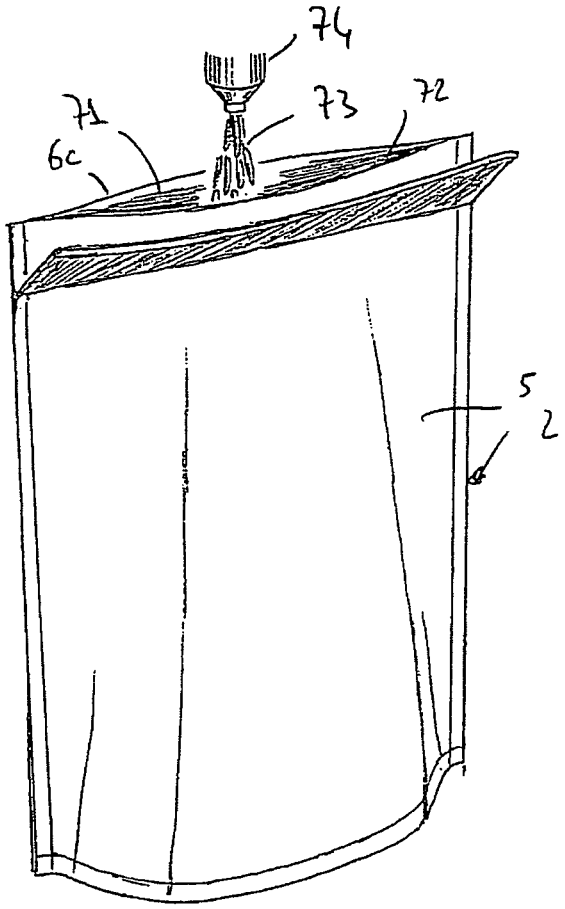
FIGS. 10-12 show respective packaging steps of a food product in a package according to the invention.
Figure 11:
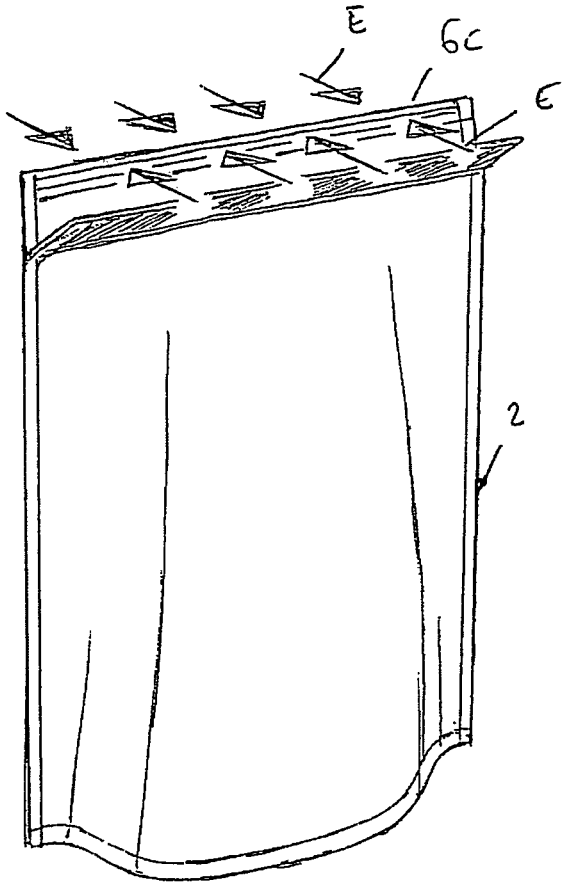
Figure 12:
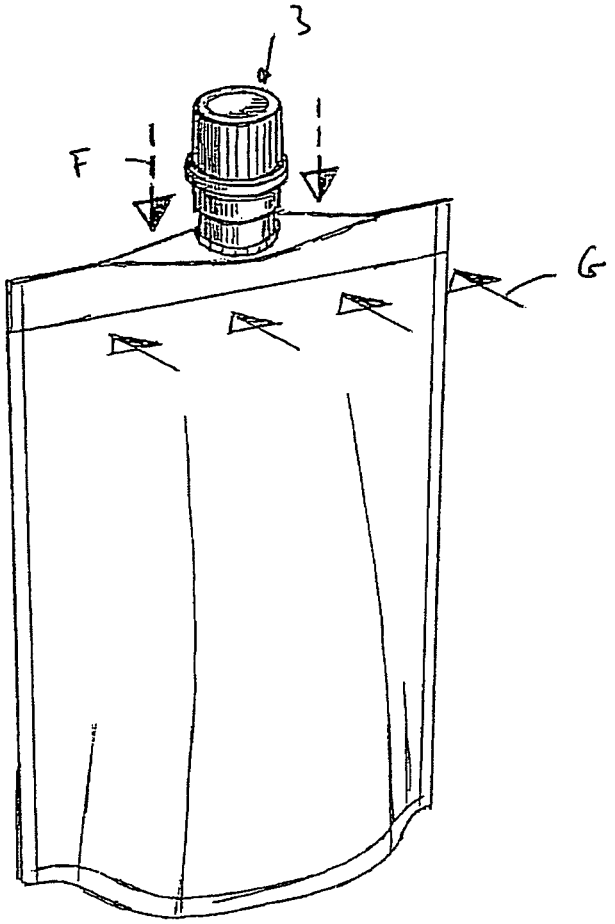

With reference now to FIGS. 10-12, a preferred packaging method is shown according to the present invention.

Such method is carried out starting from the open container 2 described above and provides a filling step of the container 2 with a quantity of a food product 73 that has been suitably predetermined by means of a meter 74 through the mouth 71 (FIG. 10).

In the case of sterile or aseptic packaging, such filling step is preceded by a step of sterilising the container 2 in a conventional manner, for example with hydrogen peroxide.

Once the filling is completed, the mouth is closed so to hermetically seal the container 2. This is carried out by sealing the free end 72 of the gusset element 10 to the edge 6*c* of the second wall 6, in such a manner closing the mouth 71 (as indicated by the arrows E in FIG. 11).

It should be noted that, in case of sterile or aseptic packaging, the aforesaid filling and closing steps of the mouth of the container 2 are carried out in sterile or aseptic conditions.

At this point, the method according to the invention provides inserting an opening and closing device of said container 2, like the device 3 described above, in a substantially central position of the pocket 14 defined by the first tilted wall 11 and the second tilted wall 12 of the gusset element (as indicated by the arrows F in FIG. 12) and sealing the tilted walls 11, 12 of the gusset element 10 together and to corresponding sealing surfaces 19 of the opening and closing device 3, so firmly constrain such device to the container 2 (as indicated by the arrows G in FIG. 12).

The invention claimed is:

1. A package for food products comprising a flexible container having a first wall and a second wall opposite each other and peripherally sealed along at least the respective side edges, a space inside the walls containing, optionally in sterile conditions, a food product, a gusset element extended between the upper edges of the first wall and of the second wall and a mouth formed between the upper edge of the first or second wall and an upper edge of the gusset element, the container being hermetically sealed through sealing of the mouth and the gusset element defining a pocket on the external side of the container which is turned towards the interior of the container and has a first tilted wall and a second tilted wall, the package also comprising an opening and closing device housed in the pocket and constrained to the flexible container, the opening and closing device comprising a pourer body associated with an opening and closing cap, and a cutter configured to perforate the flexible container at the time of the first opening of the package so as to put the inner space in fluid communication with the pourer body, wherein the pourer body comprises a base provided with a substantially cylindrical through channel of pre-established axis and wherein the base is housed in the pocket and sealed by means of its two opposite sealing surfaces to the first tilted wall and to the second tilted wall of the gusset element.

2. A package according to claim 1, wherein the gusset element is formed by a folded end portion of one of the first wall and the second wall, the end portion being extended towards the other of the first wall or the second wall, and being laterally sealed to the first wall and the second wall and to the upper edge of at least one of the first wall and the second wall.

3. A package according claim 1, wherein the gusset element has a substantially "V" shape comprising the first tilted wall and the second tilted wall converging towards the interior of the container and terminating at its lower part in a fold.

4. A package according to claim 1, characterized in that the flexible container is obtained by a single sheet of flexible material, folded and sealed so to form the first wall and the second wall, the gusset element and optionally the gusset bottom.

5. A package according to claim 1, wherein the pourer body also comprises a coaxial neck rotatably engaged in the channel of the base, the neck being provided on its lower part with the cutter.

6. A package according to claim 5, characterized in that the neck is movable in rotation in the channel between an upper end stop position wherein the cutting means are situated in the channel in the position of maximum removal from the container and a lower end stop position wherein the cutting means are in a maximum advancement position and are capable of perforating the gusset element of the container.

7. A package according to claim 5, wherein the base has a lower end portion tapered on its lower part so to have a substantially conical form in cross-section, the end portions having an axial notch with curvilinear profile formed at the channel.

8. A package according to claim 5, wherein the base also comprises a substantially cylindrical collar formed integrally therewith and projecting above it as an extension of the channel outside the base, an annular band outside the collar being provided with a plurality of teeth integrally formed in circumferential succession.

9. A package according to claim 5, wherein the neck comprises a substantially cylindrical body, coaxial with respect to the aforesaid axis and having an upper end portion provided with an outer thread along an axial part thereof, a lower end portion also provided with an outer thread along an axial part thereof, an intermediate portion free of thread and an integrally formed cylindrical jacket rising over the intermediate portion and provided on its upper part with a plurality of teeth in circumferential succession along an annular band and projecting therefrom, and on its lower part with an inner annular recess intended to be substantially fit-coupled with the teeth of the collar when the neck reaches the lower end stop.

10. A package according to claim 9, wherein the cap comprises an annular jacket externally provided with knurling and internally provided with a thread, the cap being rotatably engaged with the neck and being integral in rotation therewith by means of a thread coupling between the inner thread of the annular jacket and the outer thread of the upper end portion of the neck, the cap also having a guarantee band composing of a ring fit on the annular jacket and internally provided with a plurality of teeth which are engaged between the teeth of the cylindrical jacket of the intermediate position according to a substantially grooved coupling.

11. A package according to claim 9, wherein the neck is rotatably engaged on the lower part with the base by means of a thread coupling between the outer thread of the lower end portion and the inner thread of the channel of the base and wherein the thread of the upper end portion of the neck and the thread of the lower end portion are made in substantially opposite directions, so to allow, at the time of the first opening of the package, the perforation of the gusset element and the subsequent screwing off of the cap by means of a prolonged rotary movement in one single direction.

* * * * *